US006484405B1

(12) United States Patent
Martelli

(10) Patent No.: US 6,484,405 B1
(45) Date of Patent: Nov. 26, 2002

(54) ROTARY WHEEL CUTTING APPARATUS WITH A SPRING-BIASED BLADE COVER

(76) Inventor: John D. Martelli, 321 S. 61st Ave., Pensacola, FL (US) 32506

( * ) Notice: Subject to any disclaimer, the term of this patent is extended or adjusted under 35 U.S.C. 154(b) by 0 days.

(21) Appl. No.: 09/967,230

(22) Filed: Oct. 1, 2001

(51) Int. Cl.[7] ..... B26B 25/00

(52) U.S. Cl. ..... 30/292; 30/319

(58) Field of Search ..... 30/151, 307, 319, 30/2, 391, 292

(56) References Cited

U.S. PATENT DOCUMENTS 5,873,169 A * 2/1999 James et al. ..... 30/391

* cited by examiner

*Primary Examiner*—Douglas D. Watts
(74) *Attorney, Agent, or Firm*—George A. Bode; Lisa D. Velez; Bode & Associates

(57) ABSTRACT

A rotary-blade cutting apparatus which includes a spring-biased cutting-blade cover. The cover is spring biased to a closed position and includes a projection for manually applying a hold-open force to rotate and hold the spring-biased cover in an open or retracted position in a cutting-blade chassis. The handle of the apparatus is angled to provide for a more comfortable grip.

11 Claims, 6 Drawing Sheets

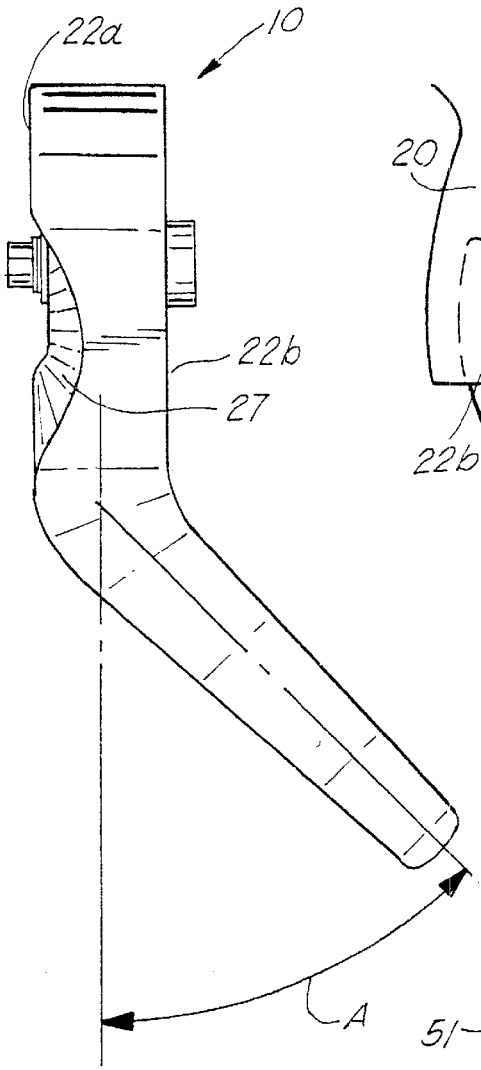
FIG. 10
FIG. 11
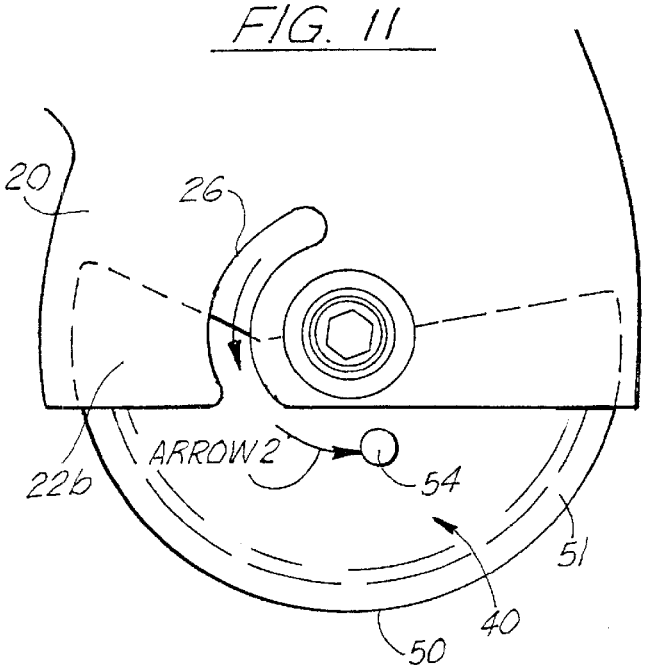
FIG. 12
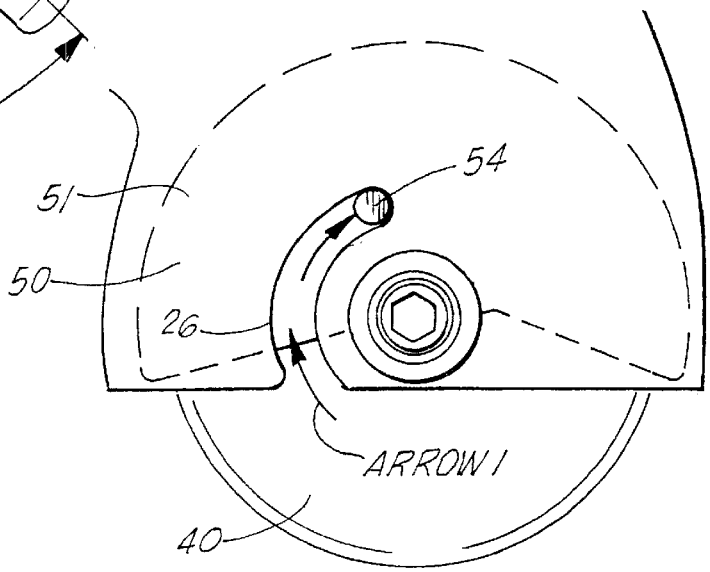

ROTARY WHEEL CUTTING APPARATUS WITH A SPRING-BIASED BLADE COVER

BACKGROUND OF THE INVENTION

1. Field of the Invention

The present invention relates to rotary wheel cutters, and more particularly, to a rotary wheel cutting apparatus with a spring-biased blade cover which automatically covers the rotary blade when a manual hold-open force is eliminated.

2. General Background

Rotary wheel cutters are used in a variety of industries which require cutting soft material such as cloth. As with other cutting implements, when the cutter is dropped or left unattended, workers are not always aware of the cutting edge and have become cut or injured. However, uncovered cutting edges not only present a hazard to personnel but also to the materials used. For example, if a cutter is dropped, the cutting edge could cut the material in a location which is undesirable.

Further, carpal tunnel, "tennis elbow" and sore neck injuries are common in this industry.

In view of the above, there is a continuing need for a rotary wheel cutting apparatus which includes a spring-biased blade cover which is biased to a closed position and which requires a manual force to hold the spring-biased blade cover open.

SUMMARY OF THE PRESENT INVENTION

The preferred embodiment of the rotary wheel cutting apparatus of the present invention solves the aforementioned problems in a straight forward and simple manner.

Broadly, the present invention contemplates a rotary wheel cutting apparatus with a spring-biased blade cover which automatically covers the rotary blade when a manual hold-open force is eliminated.

In view of the above, an object of the present invention is to provide a rotary wheel cutting apparatus with a spring-biased blade cover to minimize the occurrence of unwanted cuts in the material being cut or in personnel.

Another object of the present invention is to provide a rotary wheel cutting apparatus which is ergonomically engineered to relieve stresses off of the gripping hand and wrist and which is comfortable to hold.

A further object of the present invention is to provide a rotary wheel cutting apparatus with a spring-biased blade cover to protect the blade when not in use.

A still further object of the present invention is to provide a rotary wheel cutting apparatus with a spring-biased blade cover which automatically closes so that the user does not have to cover the rotary blade before storage.

In view of the above, a feature of the present invention is to provide a rotary wheel cutting apparatus which is easy and safe to use.

Another feature of the present invention is to provide a rotary wheel cutting apparatus which is relatively simple structurally and thus simple to manufacture.

An advantage of the of the present invention is to provide a rotary wheel cutting apparatus with a spring-biased blade cover to protect the user of the cutting apparatus from cuts or nicks if the cutting apparatus is accidentally dropped.

The above and other objects, features and advantages of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein:

FIG. 10 is a top plan view of the embodiment of FIG. 1 illustrating the angle between the cutting blade and the handle;

FIG. 11 is a partial view of the right side elevational view of the embodiment of FIG. 3 illustrating the cutting-blade cover in the closed position;

FIG. 12 is a partial view of the right side elevational view of the embodiment of FIG. 3 illustrating the cutting-blade cover (in phantom) in the retracted or open position;

DETAILED DESCRIPTION OF THE PREFERRED EMBODIMENT

Figure 1:
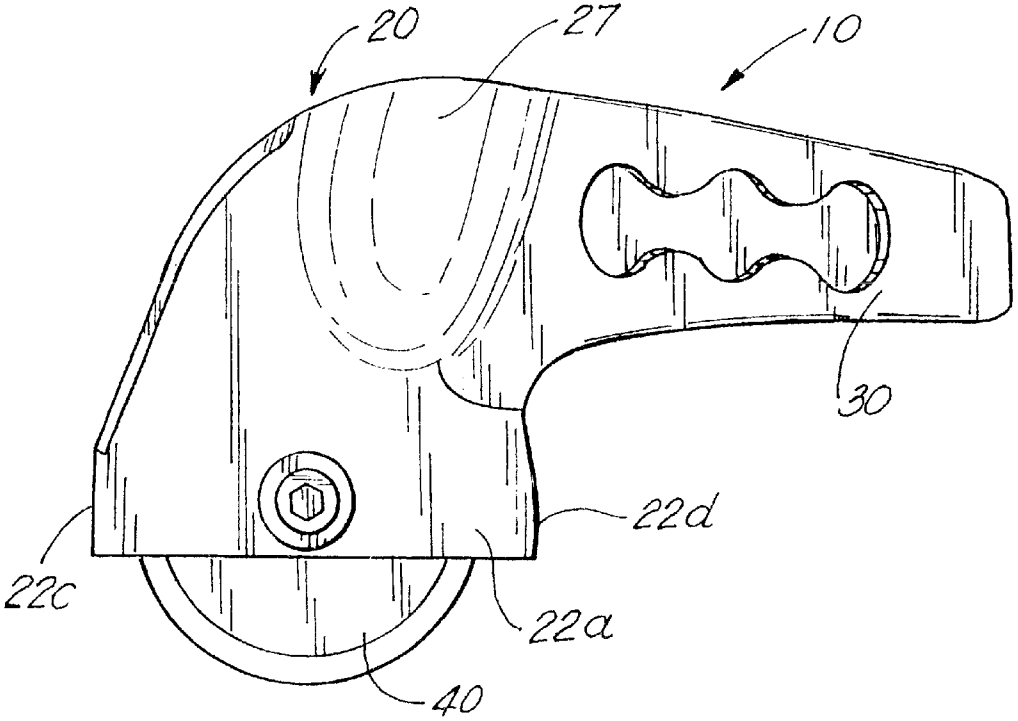
FIG. 1 is a left side elevational view of the preferred embodiment of the rotary blade cutting apparatus of the present invention.
Figure 2:
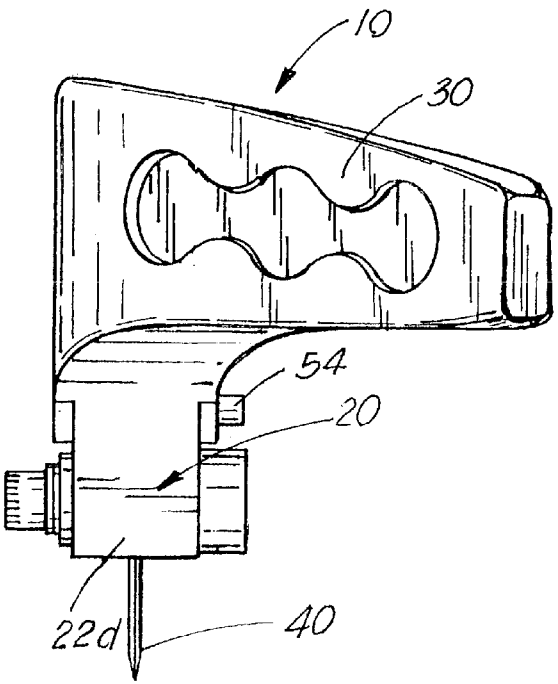
FIG. 2 is a rear elevational view of the embodiment of FIG. 1.
Figure 4:
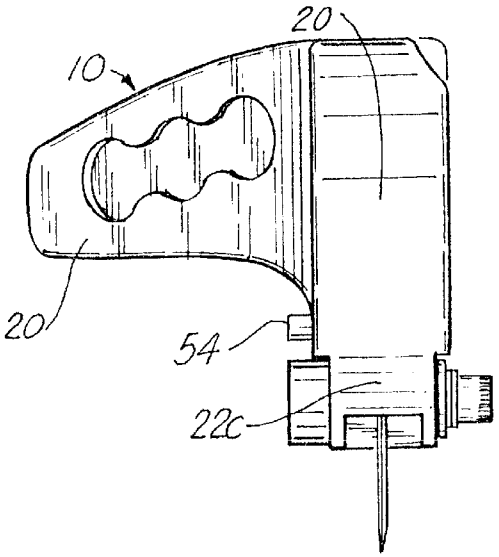
FIG. 4 is a front elevational view of the embodiment of FIG. 1.
Figure 3:
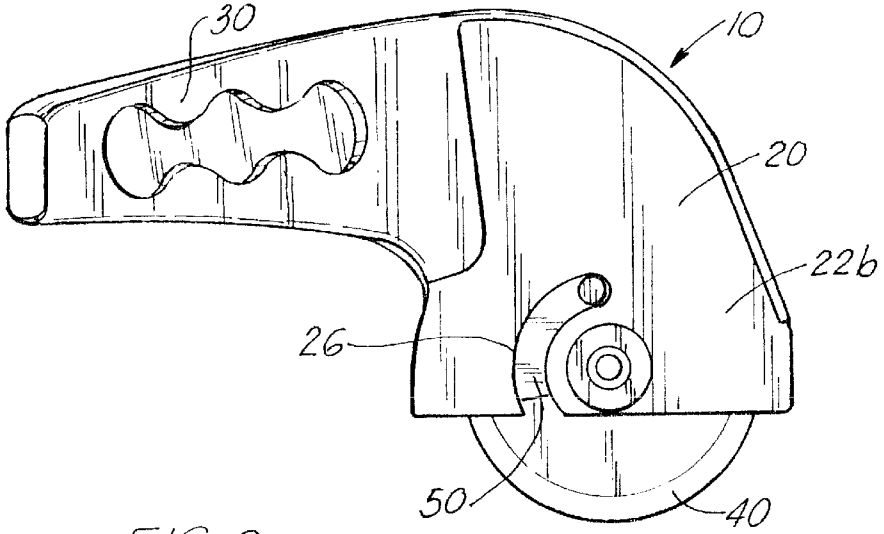
FIG. 3 is a right side elevational view of the embodiment of FIG. 1.

Referring now to the drawings and in particular FIGS. 1–9, the rotary blade cutting apparatus of the present invention is generally referenced by the numeral 10. The rotary blade cutting apparatus 10 is generally comprised of a combination cutting-blade chassis 20 and handle 30, a rotary cutting blade 40 rotatable coupled in the cutting-blade chassis 20; and a spring-biased cutting-blade cover 50, which is spring biased to a closed position.

The rotary cutting blade 40 is disc-shaped and has a portion thereof recessed in the cutting-blade chassis 20 while the remaining portion lyes outside of the cutting-blade chassis 20. The cutting-blade chassis 20 includes two parallel side surfaces 22*a* and 22*b* each having a bore hole formed therethrough and front and rear surfaces 22*c* and 22*d* to define a hollow cavity or compartment 24. In the exemplary embodiment, the hollow cavity or compartment 24 is generally rectangularly-shaped. An axil 42 is rotatable coupled between the two parallel side surfaces 22*a* and 22*b* and has fixedly coupled thereto cutting blade 40. The rotary cutting blade 40 is fixedly coupled to axil 42 (FIG. 14).

Figure 5:
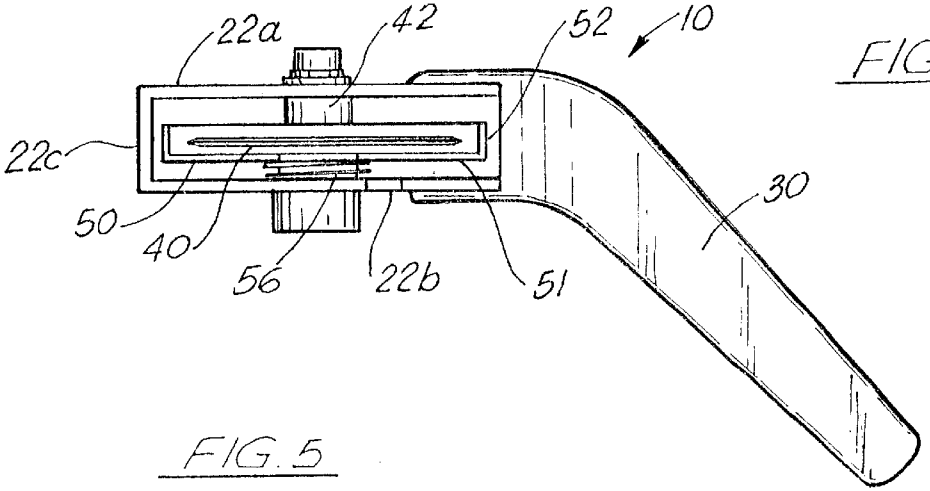
FIG. 5 is a bottom plan view of the embodiment of FIG. 1.
Figure 7:
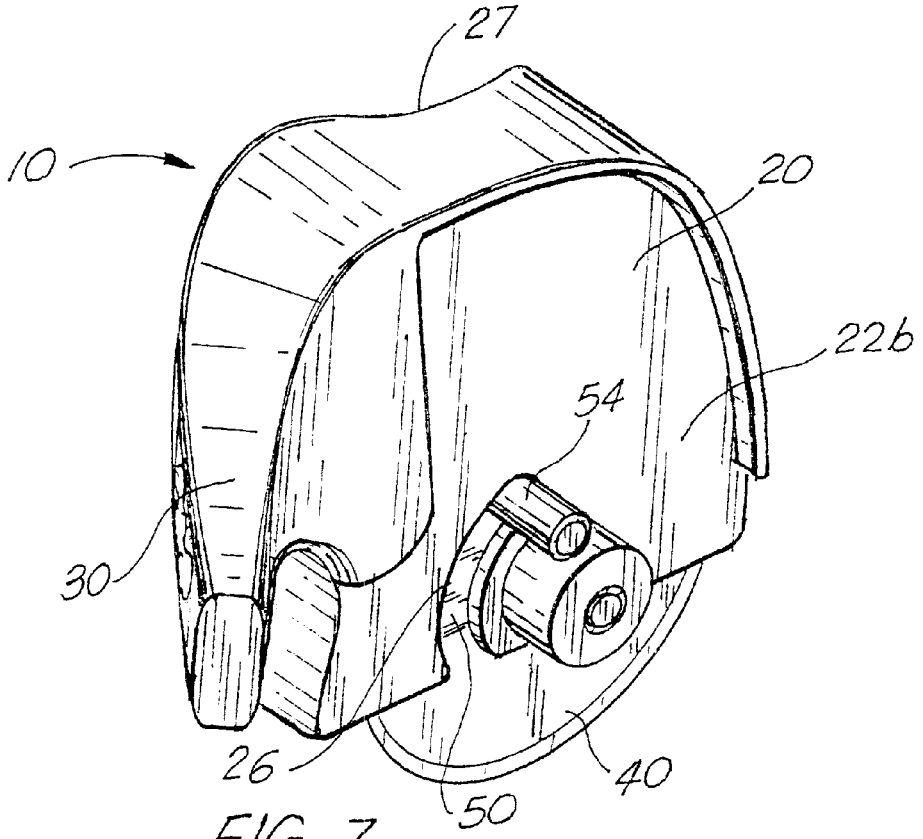
FIG. 7 is a top, rear and right side perspective view of the embodiment of FIG. 1 with the spring-biased cutting-blade cover in the retracted or open position.
Figure 6:
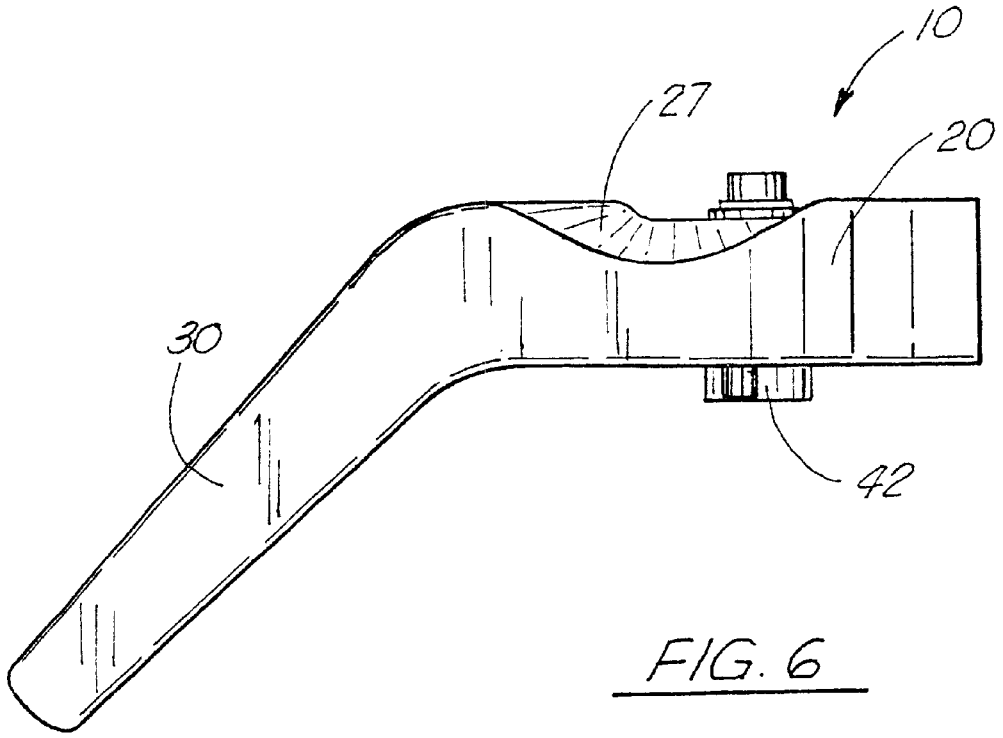
FIG. 6 is a top plan view of the embodiment of FIG. 1.
Figure 8:
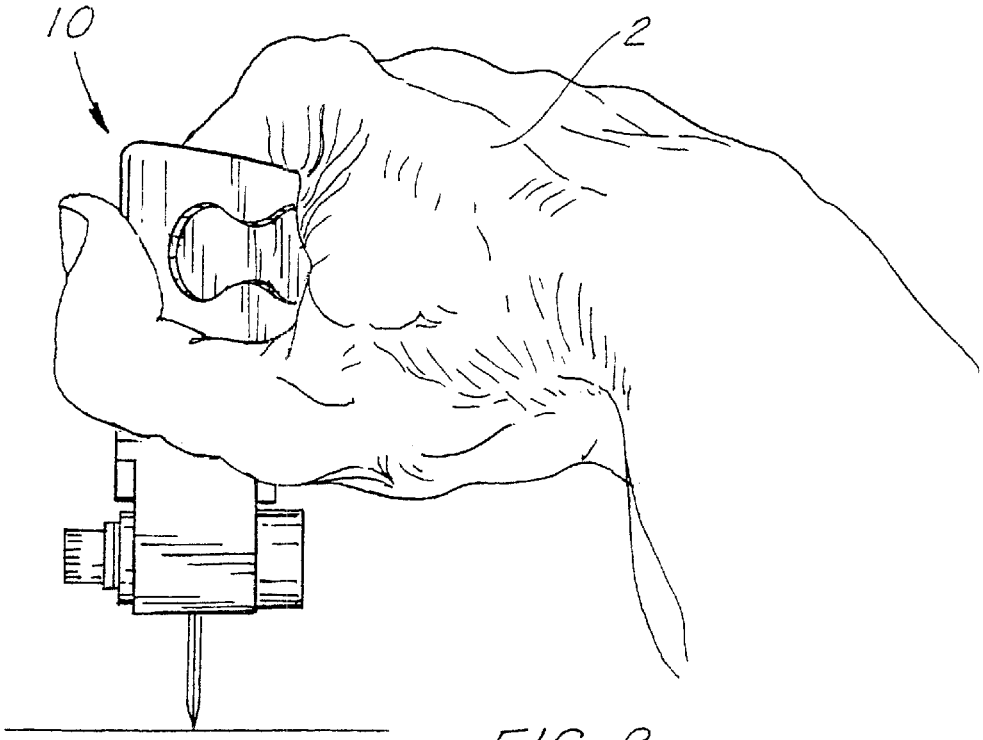
FIG. 8 is a rear elevational view of the embodiment of FIG. 1 being gripped by a hand and the spring-biased cutting-blade cover in the closed position.
Figure 9:
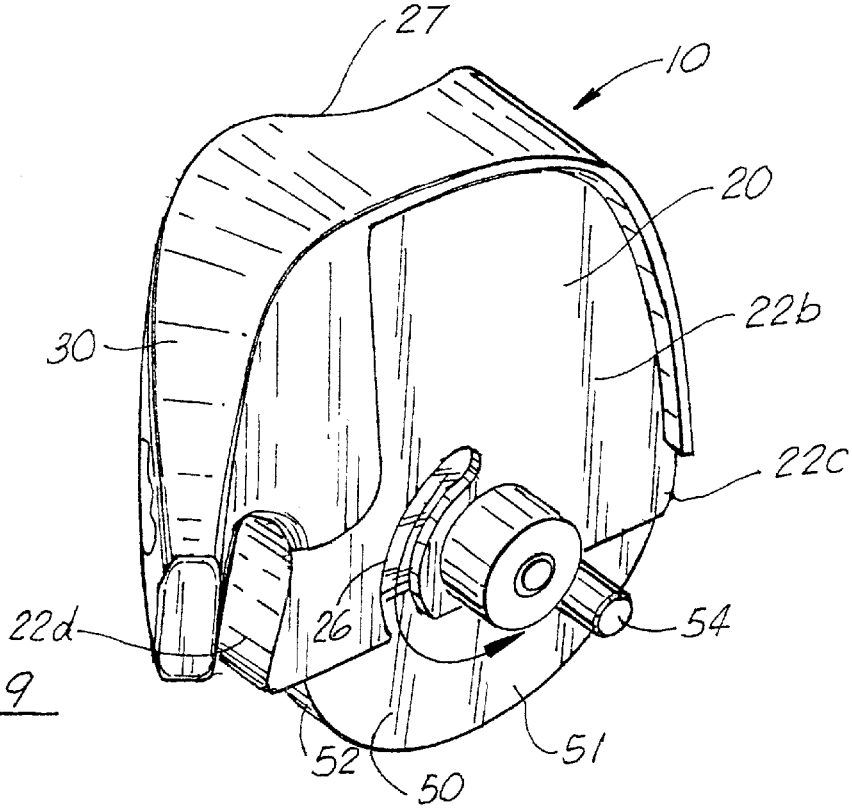
FIG. 9 is a top, rear and right side perspective view of the embodiment of FIG. 1 with the spring-biased cutting-blade cover in the closed position.
Figure 13:
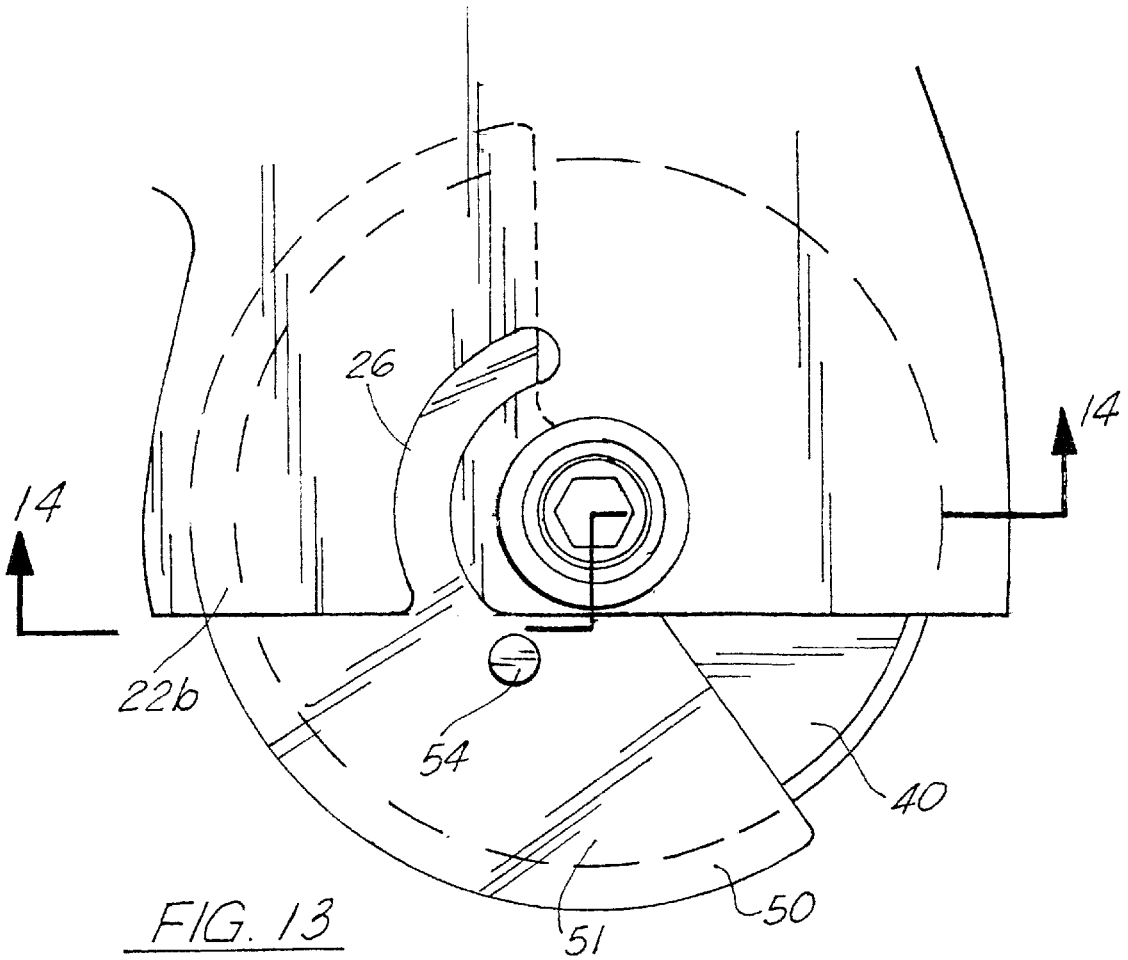
FIG. 13 is a partial view of the right side elevational view of the embodiment of FIG. 3 illustrating the cutting-blade cover in an intermediate position.
Figure 14:
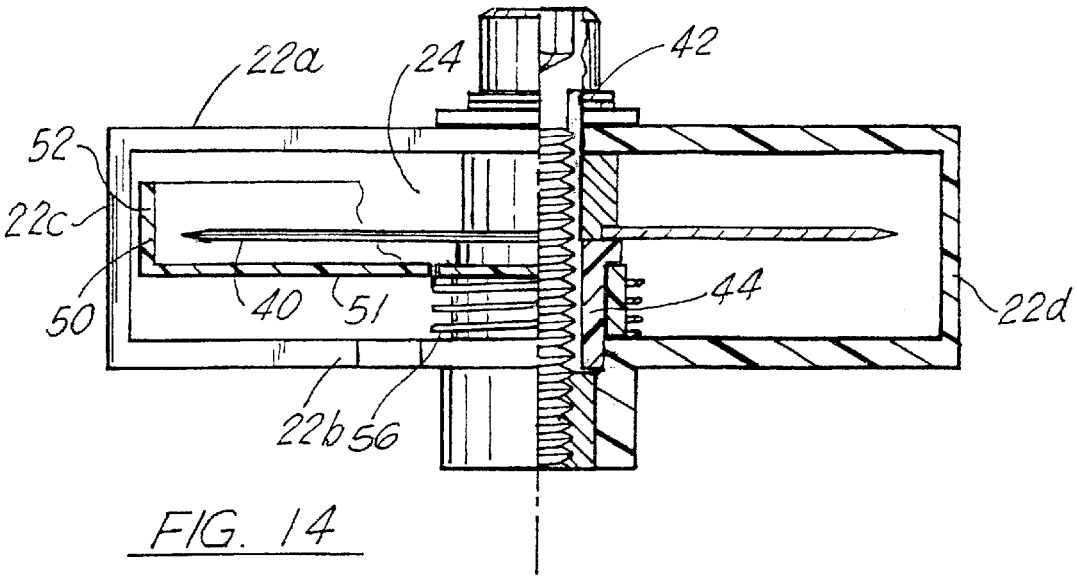
FIG. 14 is a cross-sectional view along the plane 14—14 of the embodiment of FIG. 13.

Referring also to FIGS. 11–14, the spring-biased cutting-blade cover 50 is generally pie-shaped with a portion thereof removed so that the remaining portion is greater than semi-circle. As best seen in FIGS. 5 and 14, the spring-biased cutting-blade cover 50 includes a planar substrate 51 which has the profile of the pie-shape having a portion removed and a depending lip or flange 52 around the perimeter of the substrate 51.

In an alternate embodiment, the cover 50 may include two parallel substrates in stead of only one substrate 51.

The spring-biased cutting-blade cover 50 is rotatably coupled to the axil 44, which is concentric about axil 42, and is spring biased via spring 56 to a closed position, as best seen in FIG. 11, covering the non-housed portion of the rotary cutting-blade 40, and more specifically, the cutting edge of the cutting-blade 40.

The exterior side of the cover 50 (substrate 51) includes projection 54 adapted have a force applied thereto in the direction of ARROW 1 or rearward to rotate the cover 50 into the hollow cavity or compartment 24. Side surfaces 22*b* or the right side surface has formed therein an arc-shaped channel or groove 26 adapted to receive therein the projection 54. The arc-shaped channel or groove 26 has a arc-length wherein when the projection 54 traverses the arc-length, the cover 50 is preferably fully retracted in the hollow cavity or compartment 24, as best seen in FIG. 12. Upon releasing or removal of the hold-open force, the projection 54, the front-end of the cover 50 is automatically rotated out of back-end of the hollow cavity or compartment 24 in the direction of ARROW 2 around the perimeter of the blade 40, as best seen in FIG. 13, and into the front end of the chassis 20, as best seen in FIG. 11.

In the exemplary embodiment, the chassis 20 is has a hollow interior which is adapted to fully retract therein the cover 50.

Referring now to FIG. 10, handle 30 depends from the cutting-blade chassis 20 and extends rearward and generally in a horizontal direction. The profile or width of the handle 30 slightly tapers rearwardly. In the exemplary embodiment, the handle 30 is offset from a plane perpendicular to the axis of axils 42 and 44 by an angle A. The angle A is at least 45 degrees and can be expanded to near lateral (90 degrees) and through experimentation by the inventor it has been found that 75 degrees is most ergonomically desirable. The handle 30 is angled from the plane of the cutting blade 40 in a first direction wherein an obtuse angle is formed between the right side of the chassis 20 and right side the handle 30. The positioning of the handle 30 allows the projection 54 to be easily accessed by the user's hand 2 to manually apply the hold-open force with one of the gripping fingers.

The chassis 20 further includes a discrete thumb pad or indentation 27 formed in the top right corner side of the chassis 20. As the handle 30 is gripped, the user's hand 2 can place the thumb of the hand 2 in the discrete thumb pad or indentation 27 for comfort and control of the apparatus 10.

In the preferred embodiment, the combination chassis 20 and handle 30 and cover 50 are made of rigid plastic and are lightweight and durable.

As can be appreciated, the rotary cutting-blade apparatus 10 of the present invention can be used to cut fabrics, cloth or other soft materials, boards, or the like.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A rotary-blade cutting apparatus comprising:

a combination cutting-blade chassis and handle, said chassis further comprising a discrete thumb pad or indentation formed in a top right corner side of said chassis;

a cutting blade rotatable coupled to said cutting-blade chassis, said handle being angled with respect to the plane of said cutting blade and one side of said handle forming an obtuse angle with a corresponding side of said cutting-blade chassis; and, a spring-biased cutting-blade cover, which is spring biased to a closed position and which includes a projection for manually applying a hold-open force to rotate and hold the spring-biased cover in an open or retracted position in the cutting-blade chassis.

2. The apparatus of claim 1, wherein the handle is angled at least 45 degrees with respect to the plane of the cutting blade.

3. The apparatus of claim 2, wherein a right side of the handle forms an obtuse angle with a right side of the cutting-blade chassis.

4. A rotary-blade cutting apparatus comprising:

a combination cutting-blade chassis and handle;

a cutting blade rotatable coupled to said cutting-blade chassis; and, a spring-biased cutting-blade cover, which is spring biased to a closed position and which includes a projection for manually applying a hold-open force to rotate and hold the spring-biased cover in an open or retracted position in the cutting-blade chassis, said cutting blade chassis having an arc-shaped groove formed therein having an arch length wherein the arc-shaped groove is dimensioned to receive and slide therethrough the projection to an end of the arch length to rotate the cover to the retracted or the open position in the chassis.

5. The apparatus of claim 1, wherein the chassis includes a hollow interior dimensioned to fully retract therein the cover.

6. The apparatus of claim 1, wherein the combination of the chassis and the handle and cover are made of plastic.

7. A rotary-blade cutting apparatus comprising:

means for rotatably cutting;

means for housing a portion of and rotating said cutting means;

means for gripping said housing and rotating means;

means for covering said cutting means;

means for biasing said covering means to a closed position;

means for manually applying a hold-open force to rotate and hold said covering means in an open or retracted position in said housing and rotating means, wherein said housing and rotating means have an arc-shaped groove formed therein having an arch length wherein said arc-shaped groove is dimensioned to receive and slide therethrough said hold-open force applying means to an end of said arch length to rotate said covering means to the retracted or the open position in said housing and rotating means.

8. The apparatus of claim 7, wherein said gripping means is angled at least 45 degrees with respect to the plane of said housing and rotating means.

9. The apparatus of claim 8, wherein a right side of said gripping means forms an obtuse angle with a right side of said housing and rotating means.

10. The apparatus of claim 9, wherein said housing and rotating means further comprises a discrete thumb pad or indentation formed in a top right corner side of said housing and rotating means.

11. The apparatus of claim 7, wherein said housing and rotating means includes a hollow interior dimensioned to fully retract therein said covering means.

* * * * *